US005841455A

United States Patent [19]

Tanaka et al.

[11] Patent Number: 5,841,455

[45] **Date of Patent: *Nov. 24, 1998**

[54] INK CONTAINER FOR INK JET RECORDING HAVING TWO DIFFERENT INK ABSORBING MATERIALS INCLUDING A FIBROUS MATERIAL

[75] Inventors: Shigeaki Tanaka, Kawasaki; Masami Ikeda, Tokyo; Naohito Asai, Yokohama; Nobuyuki Kuwabara, Tokyo; Makiko Kimura, Sagamihara; Teruo Arashima; Masaaki Izumida, both of Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 779,310

[22] Filed: Jan. 6, 1997

Related U.S. Application Data

[62] Division of Ser. No. 368,056, Jan. 3, 1995, Pat. No. 5,621,446, which is a continuation of Ser. No. 801,360, Dec. 2, 1991, abandoned.

[30] Foreign Application Priority Data

| | | | |
|---|---|---|---|
| Nov. 30, 1990 | [JP] | Japan | 2-329748 |
| Nov. 30, 1990 | [JP] | Japan | 2-329749 |
| Nov. 30, 1990 | [JP] | Japan | 2-329751 |
| Nov. 30, 1990 | [JP] | Japan | 2-329752 |
| Nov. 30, 1990 | [JP] | Japan | 2-329753 |
| Nov. 30, 1990 | [JP] | Japan | 2-329754 |

[51] Int. Cl.[6] ..... B41J 2/175

[52] U.S. Cl. ..... 347/87; 347/86

[58] Field of Search ..... 346/140.1; 347/86, 347/87

[56] References Cited

U.S. PATENT DOCUMENTS

| | | | |
|---|---|---|---|
| 3,967,286 | 6/1976 | Anderson et al. | 346/140 R |
| 4,017,871 | 4/1977 | Hubbard | 366/140.1 |
| 4,095,237 | 6/1978 | Amberntsson et al. | 346/140 R |
| 4,164,744 | 8/1979 | Freude | 346/140 A |
| 4,306,245 | 12/1981 | Kasugayama et al. | 346/140 R |
| 4,313,124 | 1/1982 | Hara | 346/140 R |
| 4,345,262 | 8/1982 | Shirato et al. | 346/140 R |
| 4,368,478 | 1/1983 | Koto | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,771,295 | 9/1988 | Baker et al. | 346/1.1 |
| 4,794,409 | 12/1988 | Cowger et al. | 346/140 R |
| 5,010,354 | 4/1991 | Cowger et al. | 346/140 R |
| 5,182,581 | 1/1993 | Kashimura et al. | 347/87 |

FOREIGN PATENT DOCUMENTS

| | | | |
|---|---|---|---|
| 88292 | 9/1983 | European Pat. Off. | 347/87 |
| 0425254 | 5/1991 | European Pat. Off. . | |
| 2229320 | 12/1974 | France . | |
| 59-123670 | 7/1984 | Japan . | |
| 59-138461 | 8/1984 | Japan . | |
| 59-143649 | 8/1984 | Japan . | |
| 61-078654 | 4/1986 | Japan . | |

*Primary Examiner*—Valerie Lund

*Attorney, Agent, or Firm*—Fitzpatrick, Cella, Harper & Scinto

[57] ABSTRACT

An ink container includes an ink discharging portion for discharging ink; an air vent; first liquid absorbing material for absorbing the ink therein; and a second ink absorbing material, disposed between the air vent and the first absorbing material, for absorbing the ink. The first and second absorbing materials at least partly contact each other.

31 Claims, 12 Drawing Sheets

INK CONTAINER FOR INK JET RECORDING HAVING TWO DIFFERENT INK ABSORBING MATERIALS INCLUDING A FIBROUS MATERIAL

This application is a division of application Ser. No. 08/368,056 filed Jan. 3, 1995 now U.S. Pat. No. 5,621,446, which is a continuation of application Ser. No. 07/801,360 filed Dec. 2, 1991 now abandoned.

FIELD OF THE INVENTION AND RELATED ART

The present invention relates to an ink container and a recording head having the same usable with a recording apparatus for effecting a recording operation using liquid ink in the form of a copying machine, a facsimile machine, a printer, compound machines or the like.

U.S. Pat. Nos. 4,095,237 and 4,306,245 disclose an ink container accommodating a liquid absorbing material occupying a part or the entire inside space thereof. In the latter mentioned patent, an end of the ink supply pipe communicating with an ink jet recording head is enclosed by a porous elastic material, and therefore, the ink supply performance is quite satisfactory, and is practically advantageous from the standpoint of preventing the influence of air introduced into the container.

U.S. Pat. No. 4,164,744 discloses a structure in which a coloring material is stored in a sealed container. This relates to a printing pen, and therefore, the introduction of the air in accordance with the consumption of the ink as in the case of the ink jet recording is not recognized.

U.S. Pat. No. 3,967,286 discloses an example using plural ink absorbing materials, more particularly an ink absorbing material in an ink container movable together with the recording head and a wick contacted to the ink absorbing material. However, it does not recognize the problem of the air introduction when the ink absorbing material is opened to the air.

U.S. Pat. No. 4,368,478 discloses the provision of porous material in a common liquid chamber and/or ink container of the ink absorbing portion, and discloses that the fibers are suspended in the ink at a position upstream of the porous material in the direction of the ink supply so as to prevent the porous material from being clogged with the air bubbles. This however deals with the bubbles having passed through the ink supply pipe, but does not disclose the prevention of the introduction of air into the recording head itself. This would be because the mechanism of the introduction of the bubbles is not analyzed sufficiently. It seems to be based on the assumption that the introduced air is immediately conveyed into the recording head from the ink supply container. It involves the problem that the fibers and filler materials are deposited on the inner wall of the container and the problem of insufficient ink supply when the number of ejection outlets is increased or when the apparatus is driven at a high speed.

In the prior art, the ink supply container is not capable of sufficiently supplying the ink for driving more than 10 ejection outlets or at a frequency less than 5 KHz.

European Patent Application No. 90310167.3/1990, corresponding to U.S. Ser. No. 583,136/1990 which has been assigned to the assignee of this application, proposes the internal structure of the container and the end position of the ink supply pipe wherein the influence by the introduction of the air to the ink supply performance is avoided. According to this proposal, the time required for the introduced air to reach the ink supply pipe end is significantly delayed, and is therefore, it is practical and advantageous.

The present invention relates to the problem of the introduction of air in accordance with the consumption of the ink.

The invention starts from the finding that as long as one porous ink absorbing material is used, there is a limit in delaying the arrival of the air to the ink outlet portion (as seen from the ink supply container) along the inside of the absorbing material or between the container wall and the absorbing material, and therefore, there is a limit to the reduction in the amount of the remaining unusable ink.

SUMMARY OF THE INVENTION

Accordingly, it is a principal object of the present invention to provide an ink container and a recording head using the same in which the motion of the air introduced is stopped or significantly delayed using different ink absorbing materials so as to increase the ink suppliable period.

It is another object of the present invention to provide an ink container and a recording head using the same wherein the amount of the remaining unusable ink can be minimized when the ink container accommodates an ink absorbing sponge.

It is a further object of the present invention to provide an ink container and an ink jet recording head using the same wherein plural ink absorbing materials are related so as to preclude the introduction of the air to the recording head with certainty.

It is a yet further object of the present invention to provide an ink container and an ink recording head wherein the initial conditions can be properly set for the container having plural absorbing materials.

It is a further object of the present invention to provide an ink filling method or ink refilling method for the container.

It is a further object of the present invention to provide a method for properly mounting the plural absorbing material in the ink container before the filling of the ink.

It is a further object of the present invention to provide an ink container or a recording head using the same wherein the multi-nozzle recording head having not less than 10 ejection outlets can operate assuredly on various recording materials such as paper or cloth.

According to an aspect of the present invention, there is provided an ink container comprising an ink discharging portion for discharging ink; an air vent; a first liquid absorbing material for absorbing the ink therein; and a second ink absorbing material, disposed between said air vent and said first absorbing material, for absorbing the ink, with said first and second absorbing materials being at least partly in contact with each other.

According to another aspect of the present invention, a partition member is made of flexible resin material enclosing fibrous material and compressing them in a direction transverse to the length or lengths of the fibrous materials, and said first absorbing material comprises a number of fibrous materials compressed in a direction crossing with lengths of other fibrous material, and a peripheral portion of a bundle of the fibrous material is in contact with said second absorbing material.

According to yet a further aspect of the recording head, there is provided an ink jet recording head comprising a recording head having more than 10 ejection outlets for ejecting ink and electrothermal transducers for the respective ejection outlets for creating bubbles through film boiling by thermal energy and a common chamber for supplying the ink to the ejection outlets; an ink supply member for supplying the ink to the common chamber and provided with a filter at an ink receiving end thereof; a discharging portion for discharging the ink to the ink receiving end for said ink supply member; an air vent; and a first absorbing material for absorbing ink therein. The first absorbing material comprises a number of fibrous materials in a compressed state and a flexible resin material enclosing member having an opening for exposing said fibrous materials, with said first absorbing material exhibiting an ink guiding property. Also provided is a second absorbing material for absorbing the ink disposed between said air vent and said first absorbing material. The second absorbing material is in contact with the fibrous material through the opening, is compressed to provide a vacuum, and is made of a continuous porous elastic material. Wherein in said discharging portion, a filter at the ink receiving end of said ink supply member is inserted into said first absorbing material in the direction of the length of the fibrous material, wherein a depth of the insertion is not less than 3 mm, wherein a diameter D of said ink supply member in a perpendicular cross-section with respect to a direction of the ink supply adjacent the filter of the ink supply member and a diameter d of said first absorbing material in the perpendicular cross-section adjacent to the filter satisfy $d \geqq 1.5D$, and the opening has an area of not less than 100 $mm^2$.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Figure 1:
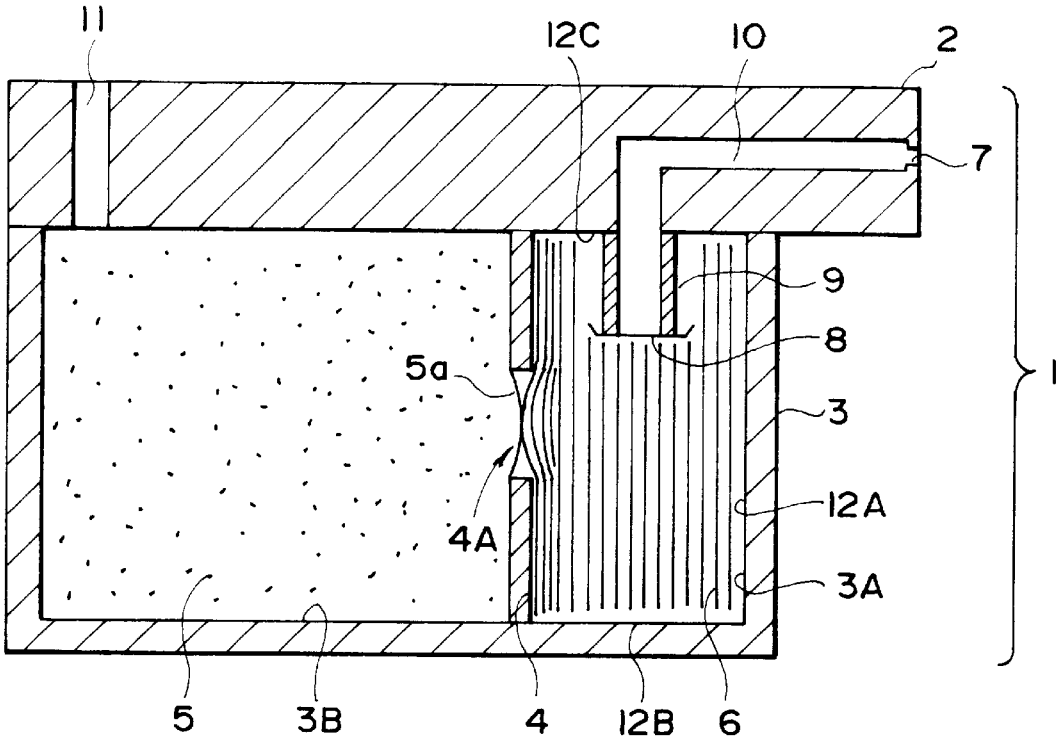
FIG. 1 is a sectional view of an ink jet recording head according to an embodiment of the present invention.

Referring to FIG. 1, there is shown in cross-section an ink jet recording head according to an embodiment of the present invention.

Reference numeral 1 designates the recording head. The recording head 1 comprises a main assembly having an ink ejecting function which will be described hereinafter and an integral ink container 3 for supplying the recording ink to the main assembly 2. The ink container 3 functions to contain the recording liquid and has a partition wall 4 for providing a first chamber 3A adjacent the main assembly and a second chamber 3B adjacent an air vent of the container, the partition wall 4 being integral with the casing of the container 3. In this example, the partition wall 4 extends substantially parallel to the wall portion 12A of the first chamber 3A. A partial opening 4A is formed substantially at the center of the partition wall 4 so that the two chambers communicate with each other. In the first chamber 3A, an end of a supply pipe 9 communicating with the main assembly 2 is inserted. The end of the supply pipe 9 is provided with a filter 8 for preventing introduction of foreign matter into an ink passage 10. The other end of the supply pipe 10 constitutes an ink discharger 7. The second chamber 3B is provided with an opening 11 communicating with ambient air (air vent). The second chamber 3B of the ink container 3 is filled with a sponge 5 (second liquid absorbing material) made of continuous fine porous material such as polyurethane or the like having sufficient elasticity and liquid absorbing property. The first chamber 3A is filled with fibers 6 (first absorbing material) in the form of a bundle of polyester resin fibers compressed and extended in the same direction.

It is desirable that the fibers 6 extend in the direction toward the end of the supply pipe 9 for the recording head, although they may be vented partially. This direction is advantageous since the ink supply property is improved. By constituting the bundle by quite a large number of fibers (8000, for example) and compressing them in a direction substantially perpendicular to the direction in which they are extended, fine capillary forces can be provided. This is effective to delay the introduction of air bubbles, and simultaneously, the increase of the size of the air bubble can be prevented. If the fibers are compressed within a proper range, the ink guiding properties are enhanced in accordance with the consumption of the ink, and therefore, the supply of the ink into the bundle of the fibers is better, and the long term ink supply is assured. Even if the air bubbles are introduced, the good ink guiding property is effective to exclude the bubbles from the bundle of the fibers. This is also advantageous from the standpoint of the ink supply.

In this embodiment, the directions in which the fibers are extended is substantially parallel with the wall surface of the partition wall 4 and the wall portion 12A of the first chamber 3A. The longitudinal end portions of the fibers assuredly contact the other wall portions 12B and 12C of the first chamber 3A which are perpendicular to the above wall surfaces. The central portion of the bundle of fibers at one end is in contact with one surface of the filter 8 for the supply pipe 9, as shown in FIG. 1.

Preferably, the central portion is press-contacted to the surface. The opening 4A of the partition wall 4 is away from the end of the supply pipe 9 by a proper distance, but they are sufficiently close to each other. In such an ink jet recording head 1, in accordance with the ejection of the ink from the ink ejector 7, the ink is gradually consumed from the neighborhood of the filter at the end of the supply pipe 9. The ink retained in the bundle of the fibers is subjected to the capillary force in the direction of the fibers, since the number of fibers are bundled and are extended in the same direction. Because of the capillary force, the ink smoothly moves along the fibers to the filter 8, and are assuredly supplied from the end of the ink supply pipe 9 to the ink ejector 7 having an unshown ink ejecting means.

As will be understood from the foregoing, if the ink is assuredly supplied to the fibers, then the ink can be assuredly supplied to the ink ejector.

For example, when the recording head is directed downwardly, the ink is supplied from the upper position, and is further supplied to the recording head by the fibers. In this case, the ink container may be sealed from the ambient air.

Referring back to FIG. 1, the ink contained in the sponge 5 in the second chamber 3B is supplied by a vacuum through the opening 4A of the partition wall 4 to that portion of the fibers in the first chamber 3A which is in contact with the sponge 5. In response to the consumption of the ink, the air enters the second chamber 3B through the air vent 11 so as to balance the pressures in the first and second chambers 3A and 3B, thus assuring the continuous supply of ink.

The relative characteristics of the fibers 6 and the sponge 5 are as follows.

First, the ink supply to the recording head is accomplished by the fibers 6, and the sponge 5 is between the fibers and the air vent. Second, the fibers and the sponge are in contact with or in press-contact with each other. Those two points are effective to delay the motion of the air in the container so that the ink can be more efficiently supplied to the recording head.

Third, the fibers 6 are better than the sponge 5 in providing the capillary force, the ink retaining characteristics and the air excluding characteristics. Therefore, the introduction of the ink mainly occurs in the sponge 5 or the space between the sponge and the inner wall surface, so that the arrival of the air at the first chamber 3A can be significantly delayed. Therefore, the quantity of the wasteful ink which remains unusably in the container can be minimized.

Here, the advantageous effects of this embodiment which are common to the embodiments which will be described hereinafter will be described in comparison with the problems with the conventional structures. In the case in which the ink container is filled with a compressed single sponge, it is known that the air enters the inside of the sponge by the vacuum of the sponge. However, before the air enters the inside of the sponge, the air may move along the inner surface of the container immediately after the consumption of the ink even up to the recording head. Once this occurs, the air exists in the form of a bubble or bubbles, and the size thereof increases with the result of reduction of the ink supply performance. For the purpose of recovery, the air can be sucked out through the recording head ejection outlets, using a sucking pump. However, this provides only a temporary recovery at the cost of a large quantity of the ink. The same problem will be repeated. In this embodiment, or in the embodiments which will be described hereinafter, the time of the occurrence of this problem can be significantly delayed, or can be completely eliminated.

Since in this embodiment, the sponge 5 and the fibers 6 are in directly contact through the opening 4A, the ink movement from the sponge 5 to the fibers 6 is smooth.

Preferable conditions of the relation between the sponge 5 and the fibers 6 in the opening 4A will be described. Since the opening 4A is defined by the partition wall 4, the opening is defined by material which is more rigid than the sponge or the fibers, and therefore, not easily deformed. The thickness of the wall 4 is preferably small, but it still has a certain thickness. Therefore, one or both of the sponge 5 and the fibers 6 are bulged into the opening. In this embodiment, the opening area is not less than 100 $mm^2$, more particularly, 200 $mm^2$, and therefore, both of them are bulged for direct contact therebetween (FIG. 1). Existence of the fibers 6 in the opening is effective to prevent movement of the air bubble from the second chamber 3B into the first chamber 3B. In other words, the reception of the ink by the fibers from the sponge 5 is enhanced. Additionally, the existence of the sponge in the opening is effective to slightly shift the center of the vacuum toward the opening 4A, and therefore, the remaining quantity of ink in the sponge can be further reduced.

Figure 2A:
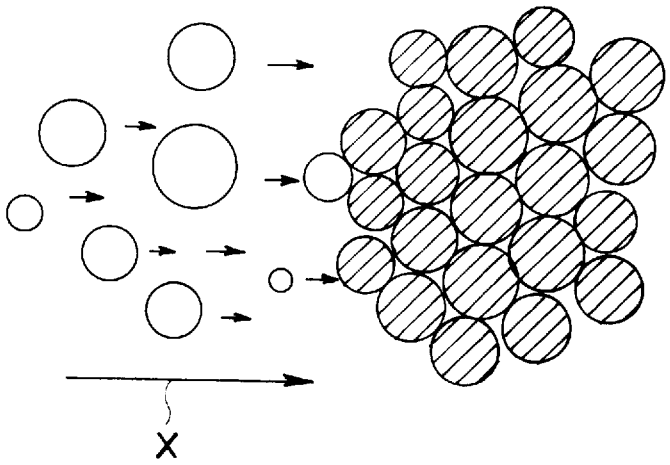
FIG. 2A schematically shows the mechanism of the air bubble introduction into a bundle of fibers (ink guiding members), when the air bubble is not capable of entering the bundle of the fibers.
Figure 2B:
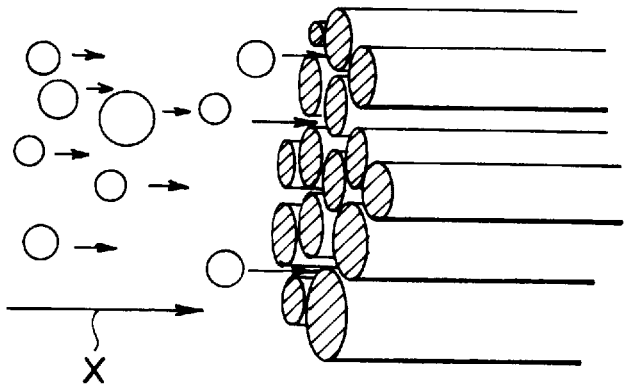
FIG. 2B shows the same when the slight amount of the air bubbles can enter the bundle of the fibers, but the prevention of air is better than in the conventional case.
Figure 7:
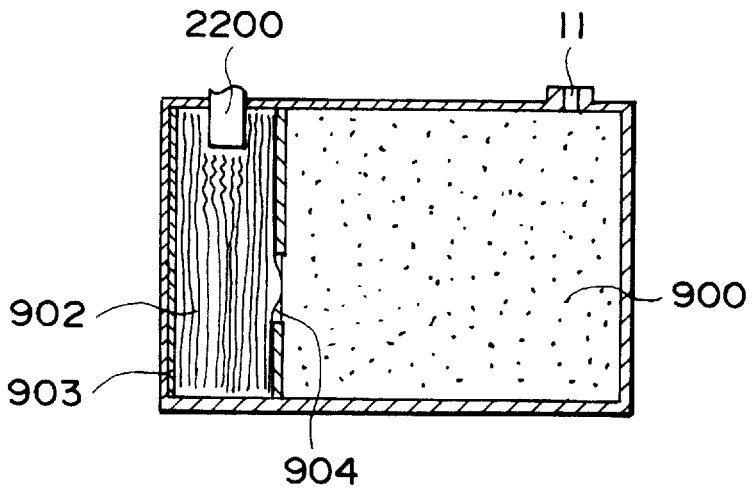
FIG. 7 is a sectional view showing the position and configuration of the absorbing material in the ink container and the position of the ink supply pipe.

In this embodiment, the state of contact between the sponge 5 and the fibers 6 is preferable. FIGS. 2A and 2B show examples of the structures usable with the present invention, but the structure of FIG. 2A is preferable. The preferable one is used in this embodiment. In FIG. 7, the reference X indicates the direction in which the ink moves from the sponge 5 to the fibers 6, and therefore, the air bubble or bubbles also move in the direction X. In FIG. 2A, the periphery of the bundle of the fibers 6, that is, the side of the bundle is contacted to the sponge 5. In other words, the direction of the ink supply from the sponge crosses with the ink guiding direction of the bundle of fibers. By this way of the contact, the introduction of the air into the fibers from the sponge can be further prevented.

When the cross-sectional surfaces of the fibers 6 are in contact with the porous material, as shown in FIG. 2B, the air bubble or bubbles retained in the bundle of fibers are confined in the fine clearances among the fibers, but the ink is more positively guided than the air bubble, and therefore, the ink can be supplied stably for a long term. The FIG. 2A arrangement is, however, better than the FIG. 2B arrangement.

Even if the air bubble enters the bundle of fibers, the contacts of the ends of the fibers to the wall surface portions 128 and 12C of the first chamber 3A is effective to expel the air bubbles toward the wall portions 12B or 12C. For this reason, the air bubbles do not reach the filter 8 of the supply pipe 9, and therefore, they are excluded from the neighborhood of the filter 8.

In addition, the opening 4A of the partition wall 4 is formed at a position away from the supply pipe 9 inlet by a proper distance, so the ink in the sponge 5 is supplied through the opening 4A and is retained by the fibers 6, and only then the ink is supplied to the ink ejector 7 through the supply pipe 9. This is also advantageous in that the introduction of the air from the sponge 5 into the ink ejector 7 is delayed significantly.

Figure 3:
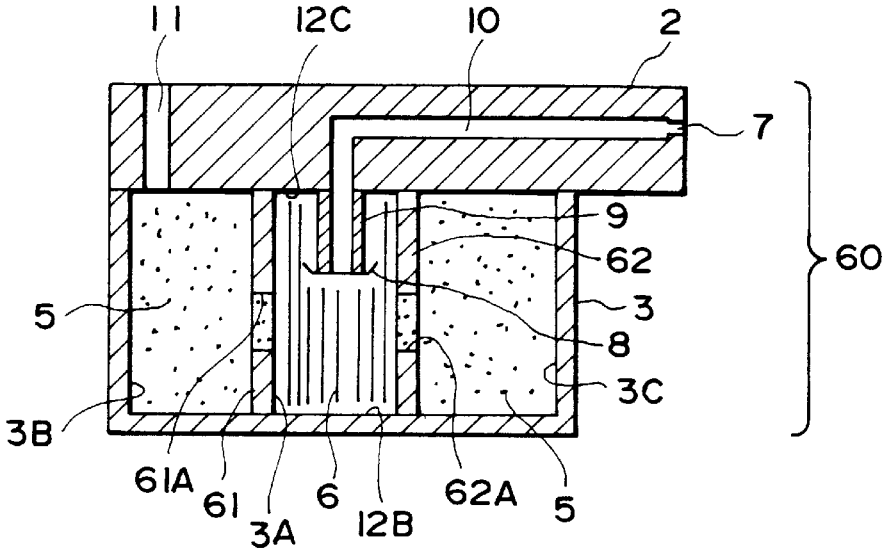
FIG. 3 is a sectional view of an ink jet recording head according to another embodiment of the present invention.

FIG. 3 is a sectional view of an ink jet recording head according to another embodiment of the present invention. In this Figure, reference numeral 60 designates the ink jet recording head. The structure of the recording head 60 is substantially the same as the recording head 1 of FIG. 1, and therefore, the same reference numerals are assigned to the elements having corresponding functions, and the detailed description thereof is omitted for simplicity. In the recording head shown in FIG. 3, the ink container 3 is provided with two partition walls 61 and 62 which are integral with the inner wall of the ink container 3. By the two partition walls 61 and 62, there are provided one first chamber 3A and two second chambers 3B and 3C adjacent and at the opposite sides of the first chamber 3A. The first and second partition walls 61 and 62 are provided with partial openings 61A and 62A substantially at the center thereof. In the first chamber 3A, an end of a supply pipe 9 in communication with the ink passage 10 and therefore, with the ink ejector 7, is inserted so that the portion of the ink pipe 9 extends parallel with the partition walls 61 and 62. The end of the supply pipe 9 is provided with the filter 8. In the first chamber 3A, fibers 6 are extended in the manner that the direction of the fibers are parallel with the partition walls 61 and 62 and that the central portion of one end of the bundle of the fibers is contacted to a surface of the filter 8 at the end of the supply pipe 9. The second chambers 3B and 3C are filled with sponges 5. Although in the Figure the air vent 11 is provided only for second chamber 3B, an unshown air vent is also provided for the second chamber 3C. The first absorbing material 5 and the second absorbing material 6 are in direct contact through the two openings 61A and 62A, respectively, so that the ink is smoothly supplied from the absorbing materials S to the absorbing material 6. In the liquid jet recording head 60, in accordance with the ejection of the ink through the ink ejector 7, the ink is gradually consumed from the neighborhood of the filter 8. Since the fibers 6 are extended in the same direction, the capillary forces are applied along the fibers. By the capillary force, the ink smoothly moves along the fibers to the filter 8. Then, the ink is supplied to the ink ejector 7 by the ink ejecting means not shown by way of the supply pipe 9. The ink contained in the first absorbing material 5 in the second chambers 3B and 3C is supplied to the second absorbing material 6 in the first chamber 3A through the openings 61A and 62A of the partition walls 61 and 62. The ink is similarly consumed from both sponges for recording. Simultaneously with the ink consumption, the air enters the second chamber 2B through the air vent 11, so that the pressures in the first chamber 3A and in the second chambers 3B and 3C, are balanced, by which the ink supply is assured.

According to this embodiment, the opening area may be larger than in the first embodiment, so the ink supply from the sponge 5 to the fibers 6 is more efficient. Since the sponges 5 and the fibers 6 are in direct contact with each other through the openings 61A and 62A, the ink movement is small. The contacts at the respective positions between the fibers 6 and the sponges 5, are the same as in the case of FIG. 2A.

In the foregoing embodiment, the partition in the ink container is provided by the partition walls 61 and/or 62, but the partition may be provided inside ribs or in a member joined to the inside surface of the container.

The partition member may be in the form of a flexible elastic sheet mounted in the ink container. In this case, by the deformation or displacement of the ink retaining material due to air or gas in the ink container, the state of ink, temperature or other ambient conditions may be accommodated by the deformation of the elastic sheet so that the ink supply can be maintained.

The partition wall may be in the form of a cylinder in which the bundle of fibers is disposed, and porous material having the elasticity and liquid absorbing characteristics may be disposed between the partition wall and the ink container.

Figure 4A:
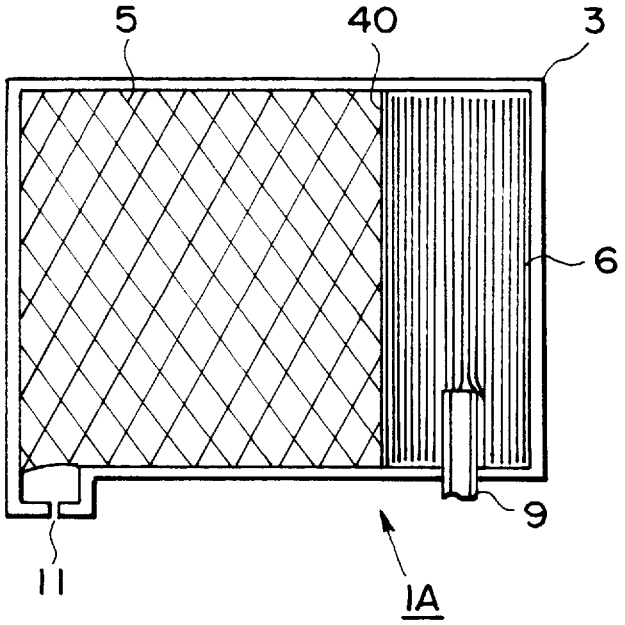
FIGS. 4A and 4B are a sectional view and a perspective view of an ink container.
Figure 4B:
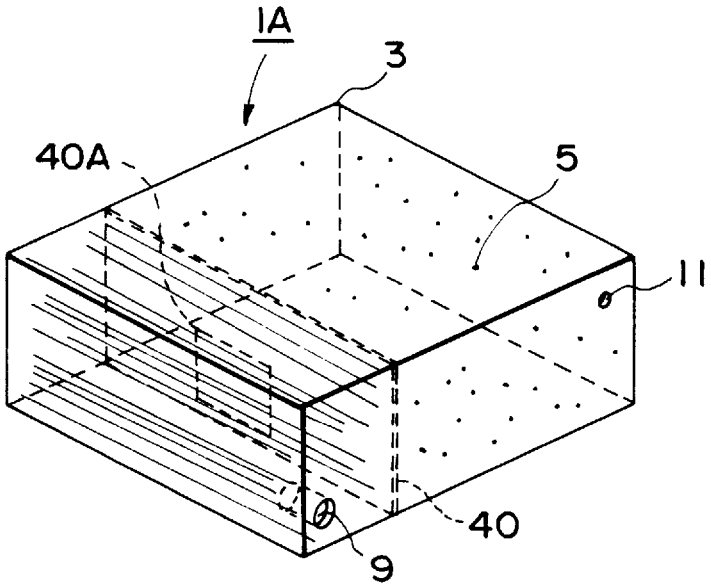
Figure 5:
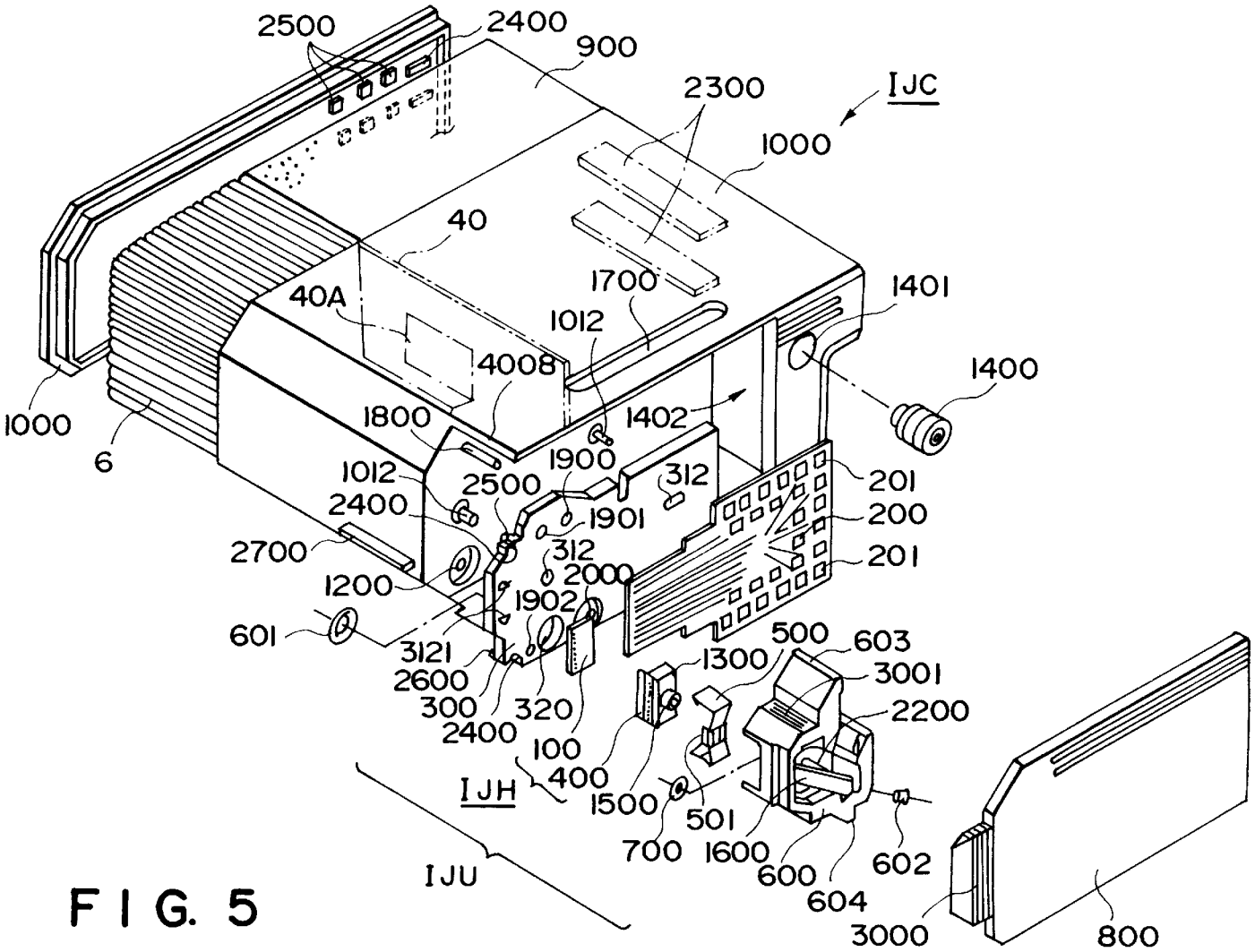
FIG. 5 is a recording head assembly having the ink container shown in FIG. 4, the head assembly being detachably mountable.

FIGS. 4A, 4B and 5 show an embodiment in which the partition member is integral with the fibers or the absorbing material, but is not fixed on the inside of the ink container.

In FIGS. 4A, 4B and 5, the fibers and the sponge providing the vacuum in the ink supply action are freely deformed when receiving the ink. In this embodiment, the stabilized vacuum and therefore the ink supply is stabilized. By the partition member, the deformation of the fibers can be suppressed to stabilize the vacuum. Thus, the contact between the sponge and the fibers can be stabilized. The motion of the air between the different absorbing materials can be prevented. The partition member usable with this embodiment may be in the form of a sheet or a plate. Preferably, it may be resin or aluminum sheet enclosing the fibers mostly to retard movement of the air or to stop it.

FIGS. 4A and 4B are a sectional view and a perspective view of the ink container of a partition sheet according to an embodiment of the present invention. In the Figures reference 1A designates an ink container. The inside of the ink container 1A is divided into two chambers by the partition member 40 having the partial opening 40A. Adjacent the ink discharging portion of the ink container, the portion (one of the chambers) connected to the communicating pipe 9 is filled with fibers 6.

The other chamber is filled with a porous material 5 having elasticity and liquid absorbing properties. Here, an air vent 11 is formed. The partition member 40 is made of flexible sheet, more particularly, polyethylene resin material in this embodiment. The ink is supplied through the pipe 9, and the quantity of the ink inside the ink container 1A decreases in accordance with the ink supply. To permit this, the space of the ink is replaced with the air through the air vent 11. However, the supply pipe 5 is isolated by the partition member 40, and by the capillary action of the fibers 6. The neighborhood of the pipe 9 is filled with the ink so that the ink supply is stabilized. In addition, since the partition member 40 is made of a flexible sheet, it can flexibly follow the internal pressure between the two materials 5 and 6 due to the supply of the ink, so that the contact between the fibers 6 and the porous material 5 is stabilized.

In FIGS. 4A and 4B, the ink supply direction by the fibers and the ink supply direction by the porous sponge cross with each other, as in the FIG. 2A example. The elastic porous material is usually compressed in the container and increases its volume when the air is introduced thereinto as a result of the ink consumption. To the contrary, the spaces between fibers expand when the ink is absorbed. When the ink is discharged therefrom, the spaces contract. Therefore, even if the volume of the bundle of the fibers changes slightly, the pressure by the porous material in the direction crossing with the fiber direction increases with the ink supply to the bundle of the fibers. This is effective to maintain good contact between them, and is also effective to maintain the capillary force by the fibers. Therefore, the ink supply to the ink container is stabilized for a long period of time.

FIG. 5 shows a bubble jet cartridge BD01 available from Canon Kabushiki Kaisha, Japan having the ink container 1A shown in FIGS. 4A and 4B. The detailed description thereof will be made hereinafter in conjunction with FIGS. 10, 11 and 12. Here, the major parts only will be described.

An ink jet cartridge IJC has a cartridge main assembly 1000, an integral ink jet unit IJU and an integral ink jet head IJH. The cartridge main assembly 1000 comprises the bundle of fibers, a partition member 40 having an opening 40A, and a porous material 900 in the order named with compression. The ink supply from the container to the head IJH is effected through an ink supply pipe 2200 penetrating the supply port 1200 and through an ink conduit 1600 to the ink inlet port 1500 of the common chamber. The ink jet head IJH forms a bubble using thermal energy, as will be described hereinafter to eject the ink. It comprises plural ejection outlets and effects on-demand recording at high frequency. With the use of the ink container 1A, the ink can be stably supplied to the recording head from the ink container, and therefore, the bubble creation using the film boiling can be stabilized.

The above embodiment uses a flexible sheet, but the same advantageous effects are provided when a flexible tube enclosing the fibers is used. It is preferable that the fibers are compressed in the tube, since then the bundle of the fibers can be easily mounted in the ink container.

As described in the foregoing, the FIGS. 4 and 5 embodiment is preferable in that the second absorbing material which is controlling with respect to the vacuum but which is deformed when receiving the ink from the first absorbing material or which is locally deformed, can be stabilized in the formation of the vacuum and in the supply of the ink. The formation of the second absorbing material is suppressed by the partition member, and the vacuum is stabilized. The contact between the first absorbing material and the second absorbing material can be stabilized, and the movement of the air or the like between the absorbing materials can be prevented.

Figure 6:
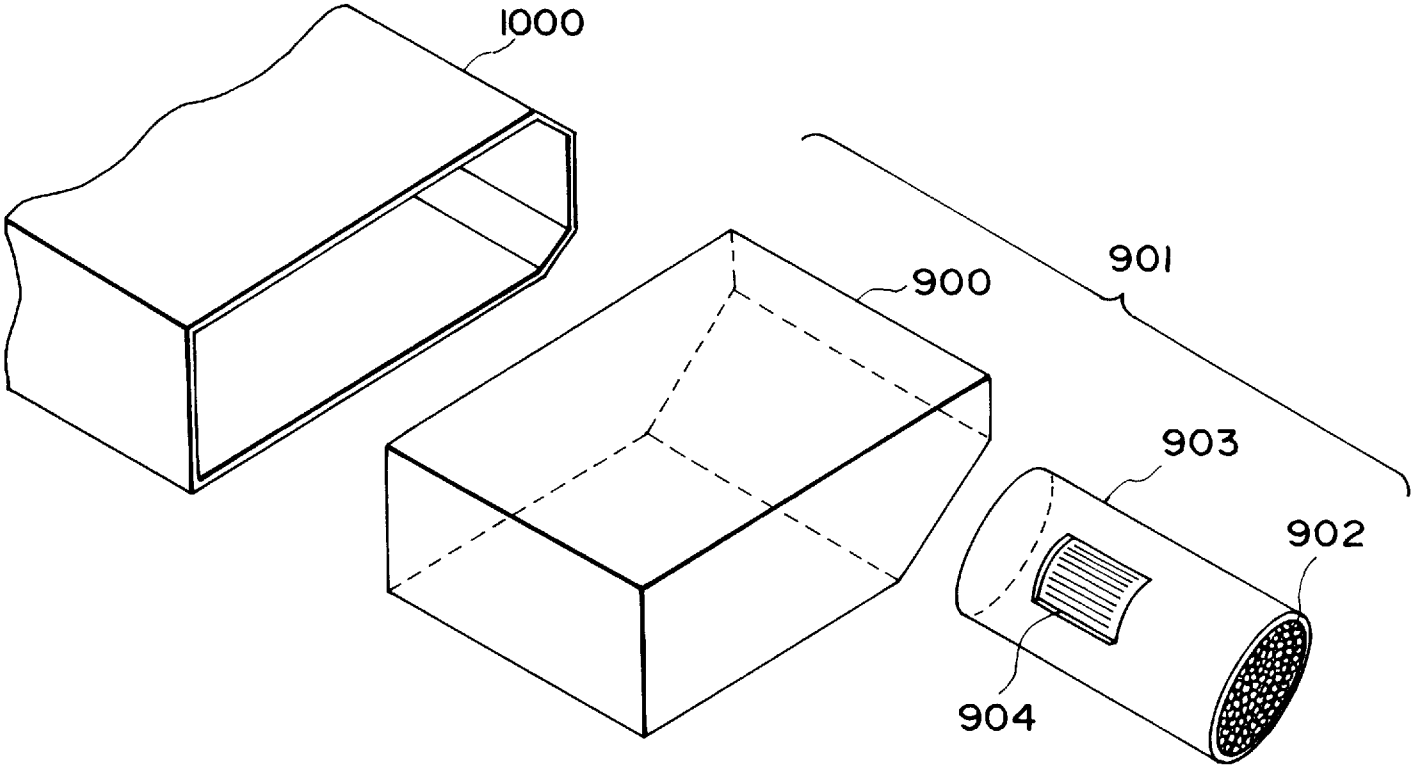
FIG. 6 is an exploded perspective view showing the internal structures of the ink accommodating container according to an embodiment of the present invention.
Figure 8:
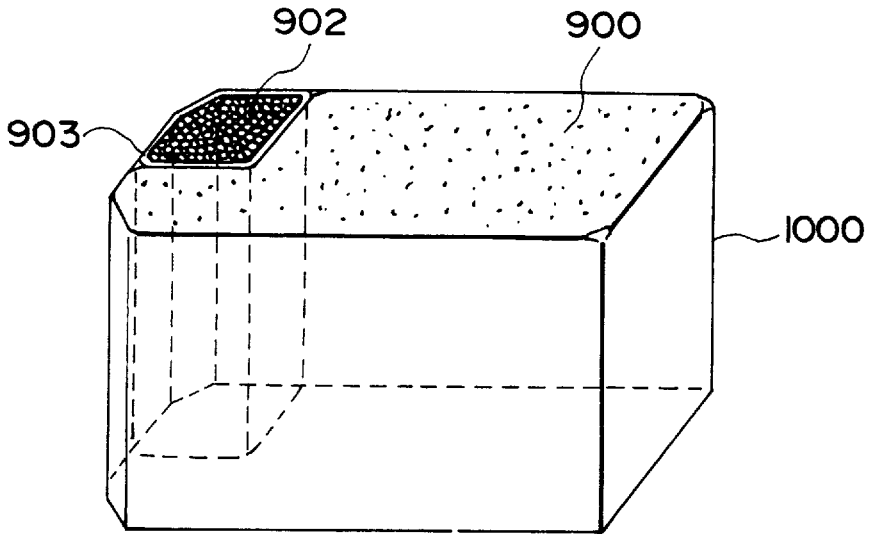
FIG. 8 shows the internal structure of the ink accommodating container, which is a modification of the FIG. 6 embodiment.

FIGS. 6, 7 and 8 show the embodiment wherein a member enclosing the fibers is used. In FIGS. 6–8, the fibers are uniformly distributed relative to the ink discharging portion, and is advantageous in that the ink supply is made uniform to the ink discharging portion. In this embodiment, the bundle of fibers and the porous material are simultaneously mounted in the ink container, by which the deformation of the bundle of the fibers is prevented, thus stabilizing the contact between the absorbing materials. The ink can be supplied thereafter with stability without the air, by which the ink communication at the contact portion is stabilized.

FIG. 6 shows an exploded view of the ink container. In this Figure, the porous material 900 is different from the foregoing embodiments and is cut at a corner to accommodate the bundle of the fibers. To the cut-away portion, an opening 904 of the cylindrical partition member is contacted with good close-contactness with the fibers 902.

The ink container comprises the porous material 900 for retaining the ink, a bundle of fibers 902 for retaining a constant amount of the ink, a tube for holding the fibers 902 and functioning as a partition member press-contacted to the porous material 901 and made of flexible material, an ink supply port 904 for supplying the ink from the porous material 900 to the fibers 902. The supply port 904 is formed in the tube 903.

FIG. 7 shows the ink container having the absorbing material 901 in the ink container 1000, and an ink supply pipe 2200 for the ink jet unit IJU inserted in the fibers 902.

The porous material 900 is made of polyurethane or the like capable of retaining the ink. It is preferably provided with and inclined or recessed portion for permitting deformation of the fibers 902. The contact between the porous material 900 and the bundle of the fibers 902 may be made at plural surfaces or by a curved surface, rather than a single flat surface, so that the ink is stably supplied. The bundle of fibers 902 functions to retain a sufficient quantity of the ink to supply the ink from the porous material 900 to the ink supply pipe 2200 of the ink jet unit IJU. The fibers in this example are made of polyester resin or the like which provides a large capillary force and which prevents introduction of the air. In addition, the direction of the fibers 902 are made parallel with the direction of the ink supply pipe 2200. The outside of the bundle of the fibers is enclosed with a flexible tube 903 made of polyethylene or the like.

With this structure, the ink is smoothly supplied to the ink jet unit, and in addition, the air coming along the internal surface of the ink container IT can be stopped so as not to introduce the air into the absorbing material. In addition, as shown in FIG. 7, the ink supply pipe 2200 can perform its function if it is inserted into the bundle of the fibers 902. In order to prevent the leakage of the ink, the end of the ink supply pipe 2200 is press-contacted to the bundle 902. The press-contact is also preferable to maintain the stabilized ink supply.

It is preferable that the porous material 900 and the bundle 902 are simultaneously mounted into the ink container IT. By the simultaneous mounting, the undesirable deformation of the bundle 902 can be prevented, and the contact area between the porous material 901 and the bundle 902 can be stabilized. In addition, the non-uniform distribution of the ink can be prevented. Furthermore, the air is prevented from remaining, thus assuring the ink movement through the contact area.

With this structure, the constant quantity of the ink can be retained at all times in the bundle of fibers adjacent the end of the ink supply pipe 2200 for supplying the ink to the ink jet head unit IJU. Therefore, the insufficient supply of the ink to the ink jet unit IJU can be prevented. The bundle 902 retains the ink by the capillary action, and therefore, the retaining characteristics are immune to temperature, humidity, pressure and impact thereto. Therefore, the conventional problem of the insufficient ink supply due to the ink retaining characteristics change resulting from the change in the ambient condition can be prevented.

FIG. 8 shows the ink container according to a further embodiment of the present invention. In this embodiment, the bundle of the fibers 902 is in the form of a rectangular cylinder. To accommodate it, the porous material 900 has a rectangular cut-away portion. The cut-away portion receives the bundle of fibers 902 enclosed with the partition member. The bundle having the rectangular cross-section is also usable with the same advantageous effects as in the foregoing embodiments.

As described in the foregoing, according to this embodiment of the present invention, the fibers are disposed between the inside surface of the container and the porous material to stably position the fibers relative to the porous material, thus preventing insufficient ink supply. Using the porous material enclosing the bundle of the fibers is preferable in that the ink retaining or ink supplying performance to the contact area is enhanced so that the efficiency of the ink supply is improved.

In addition, by the use of the fibers, the formation of the air layer can be prevented between the ink absorbing material and the ink supply pipe of the recording head, and therefore, the deterioration of the resultant image or the occurrence of the ejection failure can be assuredly prevented. Thus, the ink consumption for the recovery operation can be reduced, and the reliability of the ink jet cartridge is significantly improved. Referring to FIGS. 9–14, a preferable embodiment of the ink jet recording head and an ink jet recording apparatus will be described. In this embodiment, the ink absorbing material in the recording liquid container comprises a first absorbing material exhibiting a higher liquid absorbing property and disposed adjacent to the recording liquid supplying pipe (ink discharging side) and a second absorbing material exhibiting a lower ink absorbing property than the first liquid absorbing material. The first absorbing material and the second absorbing material are at least partly contacted to each other so as to provide the vacuum.

Figure 9:
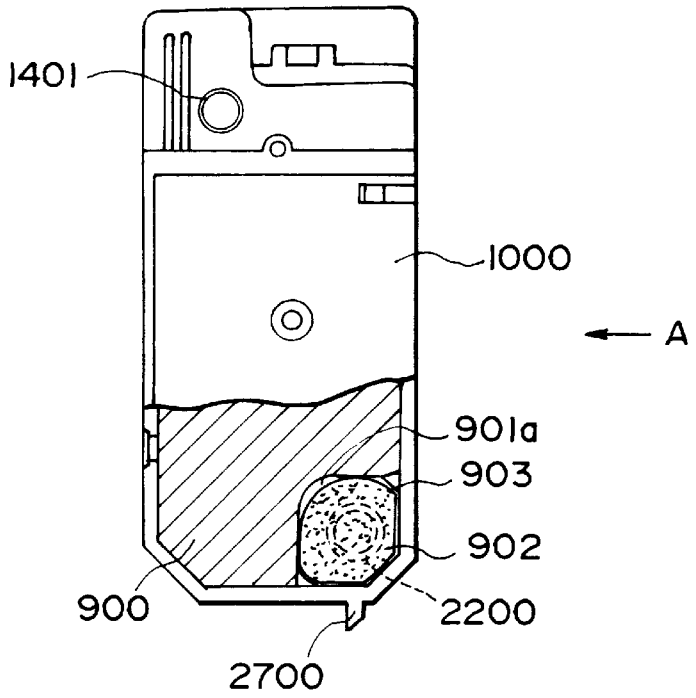
FIG. 9 shows a structure of an ink container constituting an ink jet recording head.

FIG. 9 shows an ink container constituting a part of the liquid jet recording head.

Figure 11:
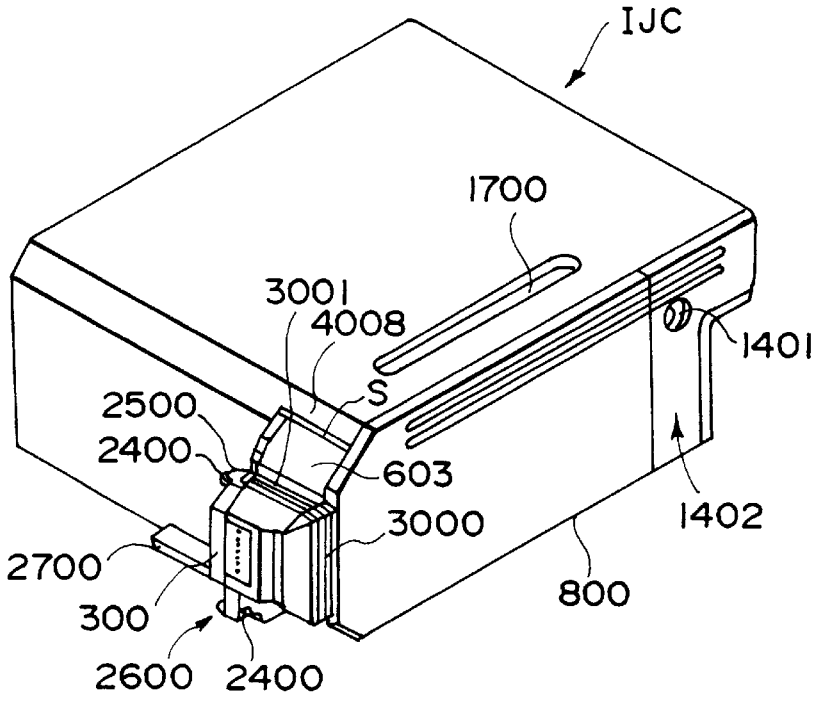
FIG. 11 is a perspective view of an ink jet cartridge.
Figure 10:
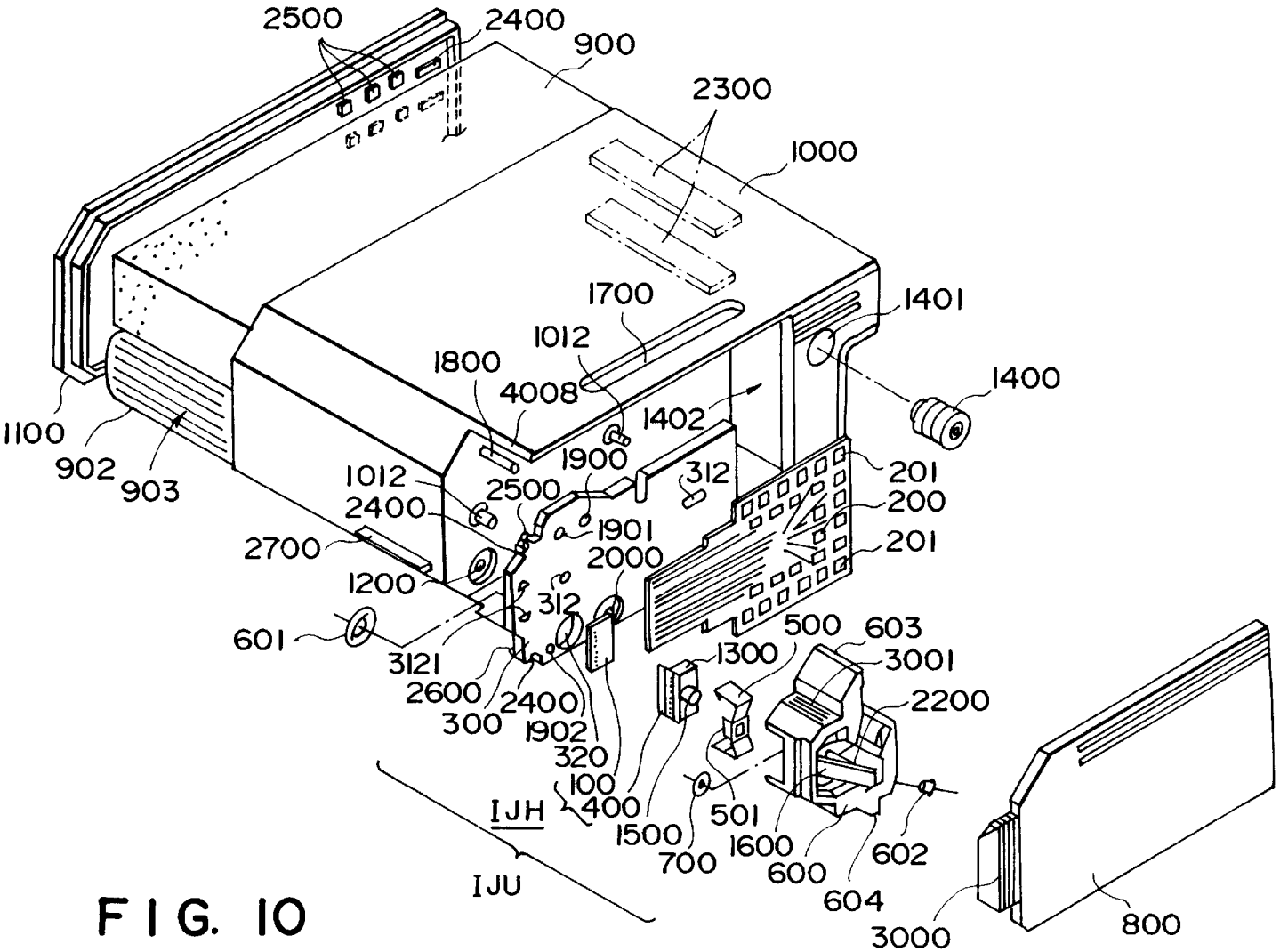
FIG. 10 shows an ink jet cartridge according to an embodiment of the present invention.
Figure 12:
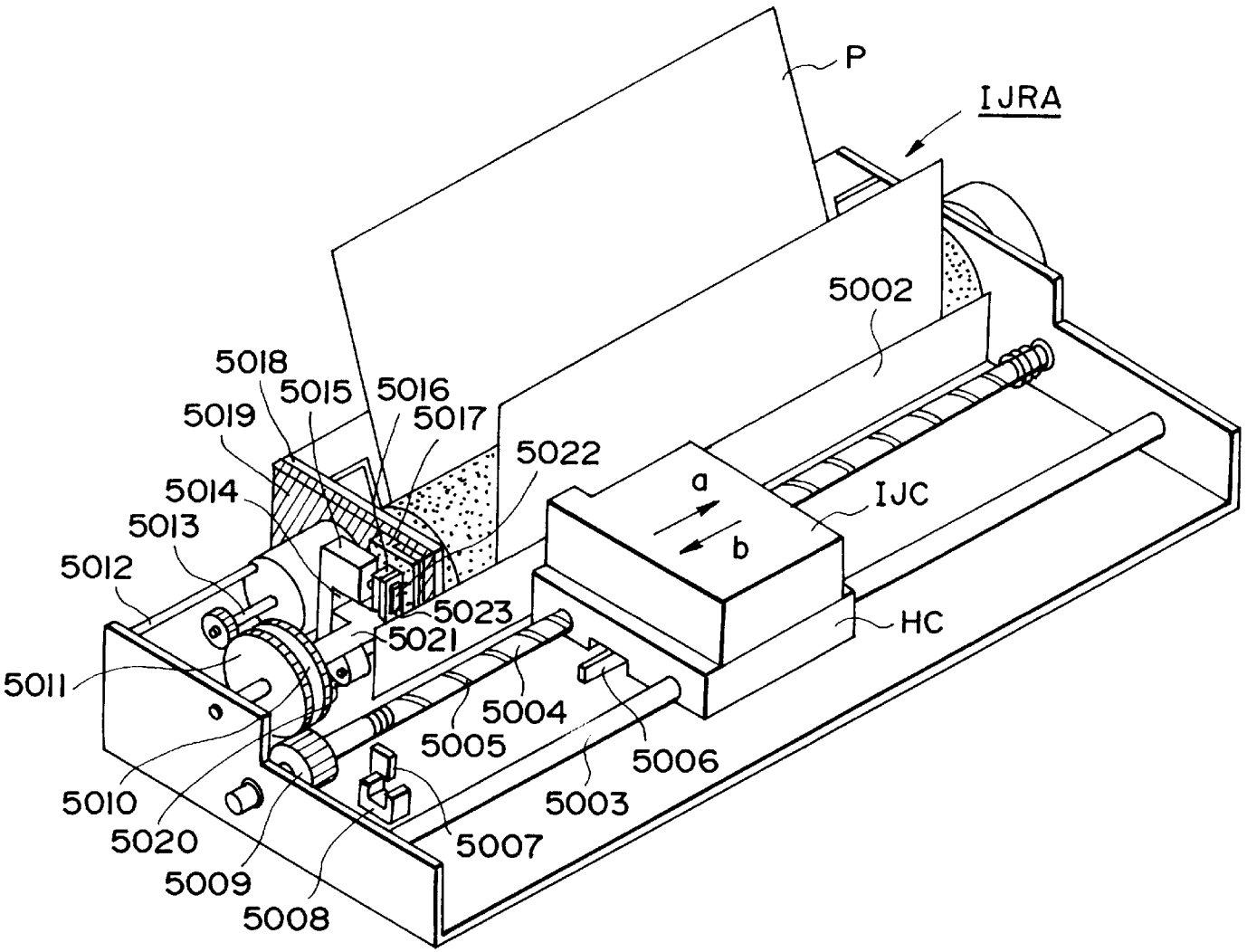
FIG. 12 is a schematic view of an ink jet recording apparatus.

Referring to FIGS. 10, 11 and 12, the description will be made, before describing the ink container of FIG. 9, as to an ink jet unit IJU, an ink jet head IJH, an ink container IT, an ink jet cartridge IJC, an ink jet recording apparatus main assembly IJRA, and a carriage HC to which the present invention is suitably incorporated.

As will be understood from FIG. 11 which is a perspective view, the ink jet cartridge IJC of this embodiment has a large ink absorbing region by projecting the ink jet unit IJU slightly beyond the front surface of the ink container IT. The ink jet cartridge IJC is supported by an unshown positioning means of the carriage HC in the ink jet recording apparatus main assembly IJRA and by electric contacts. The ink jet cartridge IJC is detachably mountable to the carriage HC, wherein the ink can be refilled.

(i) Ink Jet Unit IJU

The ink jet unit IJU is of an ink jet recording type using electrothermal transducers which generate thermal energy, in response to electric signals, to produce film boiling of the ink.

Referring to FIG. 10, the unit comprises a heater board 100 having electrothermal transducers (ejection heaters) arranged in a line on an Si substrate and electric lead lines made of aluminum or the like to supply electric power thereto. The electrothermal transducer and the electric leads are formed by a film forming process. A wiring board 200 is associated with the heater board 100 and includes wiring corresponding to the wiring of the heater board 100 (connected by the wire bonding technique, for example) and pads 201 disposed at an end of the wiring to receive electric signals from the main assembly of the recording apparatus.

A top plate 1300 is provided with grooves which define partition walls for separating adjacent ink passages and a common liquid chamber for accommodating the ink to be supplied to the respective ink passages. The top plate 1300 is formed integrally with an ink jet opening 1500 for receiving the ink supplied from the ink container IT and directing the ink to the common chamber, and also with an orifice plate 400 having the plurality of ejection outlets corresponding to the ink passages. The material of the integral mold is preferably polysulfone, but may be another molding resin material.

A supporting member 300 is made of metal, for example, and functions to support a backside of the wiring board 200 in a plane, and constitutes a bottom plate of the ink jet unit IJU. A confining spring 500 is in the form of "M" having a central portion urging to the common chamber with a light pressure, and a clamp 501 urges concentratedly with a line pressure to a part of the liquid passage, preferably the part in 5 the neighborhood of the ejection outlets. The confining spring 500 has legs for clamping the heater board 100 and the top plate 1300 by penetrating through the openings 3121 of the supporting plate 300 and engaging the back surface of the supporting plate 300. Thus, the heater board 100 and the top plate 1300 are clamped by the concentrated urging force by the legs and the clamp 501 of the spring 500. The supporting plate 300 has positioning openings 312, 1900 and 2000 engageable with two positioning projections 1012 and positioning and fuse-fixing projections 1800 and 1801 of the ink container IT. It further includes projections 2500 and 2600 at its backside for the positioning relative to the carriage HC of the main assembly IJRA.

In addition, the supporting member 300 has a hole 320 through which an ink supply pipe 2200, which will be described hereinafter, is penetrated for supplying ink from the ink container. The wiring board 200 is mounted on the supporting member 300 by a bonding agent or the like. The supporting member 300 is provided with recesses 2400 and 2400 adjacent the positioning projections 2500 and 2600.

As shown in FIG. 11, the assembled ink jet cartridge IJC has a head projected portion having three sides provided with plural parallel grooves 3000 and 3001. The recesses 2400 and 2400 are located at extensions of the parallel grooves at the top and bottom sides to prevent the ink or foreign matter moving along the groove from reaching the projections 2500 and 2600. The covering member 800 having the parallel grooves 3000, as shown in FIG. 11, constitutes an outer casing of the ink jet cartridge IJC and cooperates with the ink container to define a space for accommodating the ink jet unit IJU. The ink supply member 600 having the parallel groove 3001 has an ink conduit pipe 1600 communicating with the abovedescribed ink supply pipe 2200 and cantilevered at the supply pipe 2200 side. In order to assure the capillary action at the fixed side of the ink conduit pipe 1600 and the ink supply pipe 2200, a sealing pin 602 is inserted.

A gasket 601 seals the connecting portion between the ink container IT and the supply pipe 2200. A filter 700 is disposed at the container side end of the supply pipe.

The ink supply member 600 is molded, and therefore, it is produced at low cost with high positional accuracy. In addition, the cantilevered structure of the conduit 1600 assures the press-contact between the conduit 1600 and the ink inlet 1500 even if the ink supply member 600 is mass-produced.

In this embodiment, the complete communicating state can be assuredly obtained simply by flowing sealing bonding agent from the ink supply member side under the press-contact state. The ink supply member 600 may be fixed to the supporting member 300 by inserting and penetrating backside pins (not shown) of the ink supply member 600 through the openings 1901 and 1902 of the supporting member 300 and by heat-fusing the portion where the pins are projected through the backside of the supporting member 300. The slight projected portions thus heat-fused are accommodated in recesses (not shown) in the ink jet unit (IJU) mounting side surface of the ink container IT, and therefore, the unit IJU can be correctly positioned.

(ii) Ink Container IT

The ink container comprises a main body 1000, a first ink absorbing material 900, a second ink absorbing material 902 and a cover member 1100 for sealing the cartridge after the absorbing materials 901 are inserted through a side opposite from the unit mounting side of the assembly 1000. The ink absorbing material 900 is inserted into the main body 1000 from the side opposite from the unit (IJU) mounting side, and thereafter, the cover member 1100 seals the main body.

The second absorbing material 902 is enclosed with a flexible sheet 903 having an opening (not shown), and the opening portion is press-contacted to the first ink absorbing material 900, when it is disposed in the main assembly 1000. An ink supply opening 1200 functions to supply the ink to the unit IJU comprising the various elements 100–600. The opening also functions as an injection port for supplying the ink to the absorbing materials 900 and 902 therethrough before the unit is mounted to the portion 1010 of the main assembly 1000 of the cartridge.

In this embodiment, the ink may be supplied through an air vent port and this supply opening. In order to provide a good supply of ink, ribs 2300 are formed on the inside surface of the main body 1000, and ribs 2301 and 2302 are formed on the inside of the cover member 1100, which are effective to provide within the ink container an ink existing region extending continuously from the air vent port side to that corner portion of the main body which is most remote from the ink supply opening 1200. The number of the ribs 2300 in this embodiment is four, and the ribs 2300 extend parallel to a movement direction of the carriage adjacent the rear side of the main body of the ink container, by which the absorbing material 900 is prevented from closely contacting the inner surface of the rear side of the main body. The partial ribs 2400 and 2500 are formed on the inside surface of the cover member 1100 at a position which is substantially an extension of the ribs 2300. However, as contrasted to the large rib 2300, the size of the ribs 2301 and 2302 are small as if it is divided ribs, so that the air existing space is larger with the ribs 2400 and 2500 than with the rib 2300. The ribs 2302 and 2301 are distributed on the entire area of the cover member 1100, and the area thereof is not more than one half of the total area. Because of the provisions of the ribs, the ink in the corner region of the ink absorbing material which is most remote from the supply opening 1200 can be stably and assuredly supplied to the inlet opening by capillary action. The cartridge is provided with an air vent port 1401 for communication between the inside of the cartridge with the outside air. Inside the vent port 1401, there is a water stopping material 1400 to prevent the inside ink from leaking outside through the vent port 1401.

The ink accommodating space in the ink container IT is substantially rectangular parallelepiped, and the long side faces in the direction of carriage movement, and therefore, the above-described rib arrangements are particularly effective. When the long side extends along the movement direction of the carriage, or when the ink containing space is in the form of a cube, the ribs are preferably formed on the entire surface of the inside of the cover member 1100 to stabilize the ink supply from the ink absorbing material 900. The cube configuration is preferable from the standpoint of accommodating as much ink as possible in the limited space. However, from the standpoint of using the ink with a minimum part in the ink container, the provisions of the ribs formed on the two surfaces constitute a corner.

In this embodiment, the inside ribs 2301 and 2302 of the ink container IT are substantially uniformly distributed in the direction of the thickness of the ink absorbing material having the rectangular parallelepiped configuration. Such a structure is significant, since the air pressure distribution in the ink container IT is made uniform when the ink in the absorbing material is consumed so that the quantity of the remaining unavailable ink is substantially zero. It is preferable that the ribs are disposed on the surface or surfaces outside a circular arc having the center at the projected position on the ink supply opening 1200 on the top surface of the rectangular ink absorbing material and having a radius which is equal to the long side of the rectangular shape, since then the ambient air pressure is quickly established for the ink absorbing material present outside the circular arc. The position of the air vent of the ink container IT is not limited to the position of this embodiment if it is good for introducing the ambient air into the position where the ribs are disposed.

After the ink jet cartridge IJC is assembled, the ink is supplied from the inside of the cartridge to the chamber in the ink supply member 600 through a supply opening 1200, the hole 320 of the supporting member 300 and an inlet formed in the backside of the ink supply member 600. From the chamber of the ink supply member 600, the ink is supplied to the common chamber through the outlet, supply pipe and an ink inlet 1500 formed in the top plate 1300. The connecting portion for the ink communication is sealed by silicone rubber or butyl rubber or the like to assure the hermetical seal.

In this embodiment, the top plate 1300 is made of resin material having resistivity to the ink, such as polysulfone, polyether sulfone, polyphenylene oxide, polypropylene. It is integrally molded in a mold together with an orifice plate portion 400.

As described in the foregoing, the integral part comprises the ink supply member 600, the top plate 1300, the orifice plate 400 and parts integral therewith, and the ink container body 1000. Therefore, accuracy in assembling is improved, and is convenient in the mass-production. The number of parts is smaller than in conventional devices, so that good performance can be assured.

(iii) General Arrangement of the Apparatus

FIG. 12 is a perspective view of an ink jet recording apparatus IJRA in which the present invention is used. A lead screw 5005 rotates by way of drive transmission gears 5011 and 5009 by the forward and backward rotation of a driving motor 5013. The lead screw 5005 has a helical groove 5004 with which a pin (not shown) of the carriage HC is engaged, by which the carriage HC is reciprocable in directions a and b. A sheet confining plate 5002 confines the sheet on the platen over the carriage movement range. Home position detecting means 5007 and 5008 are in the form of a photocoupler to detect presence of a lever 5006 of the carriage, in response to which the rotational direction of the motor 5013 is switched. A supporting member 5016 supports the front side surface of the recording head to a capping member 5022 for capping the recording head. Sucking means 5015 functions to suck the recording head through the opening 5023 of the cap so as to recover the recording head.

A cleaning blade 5017 is moved toward the front and rear by a moving member 5019. They are supported on the supporting frame 5018 of the main assembly of the apparatus. The blade may be in another form, more particularly, a known cleaning blade. A lever 5021 is effective to start the sucking recovery operation and is moved with the movement of a cam 5020 engaging the carriage, and the driving force from the driving motor is controlled by known transmitting means such as a clutch or the like.

The capping, cleaning and sucking operations can be performed when the carriage is at the home position by the lead screw 5005, in this embodiment. However, the present invention is usable in another type of system wherein such operations are effected at different timing. The individual structures are advantageous, and in addition, the combination thereof is further preferable.

In FIG. 9, there are shown a first ink absorbing material 900 and a second ink absorbing material 902. The second ink absorbing material 902 has higher ink absorbing characteristics than the first ink absorbing material 900. In this embodiment, the first ink absorbing material 900 is of urethane resin material, and the second ink absorbing material 902 is a one directional bundle of polyester fibers.

The second ink absorbing material 902 is enclosed with a flexible sheet 903 having an opening (not shown) at a part thereof. The first and second ink absorbing materials 900 and 902 are disposed so as to press-contact with each other through the opening and are accommodated in the main assembly 1000 of the ink container cartridge.

FIGS. 13A, 13B, 14A and 14B show the first ink absorbing material 900 and the second ink absorbing material 902 according to an embodiment of the present invention.

Figure 13A:
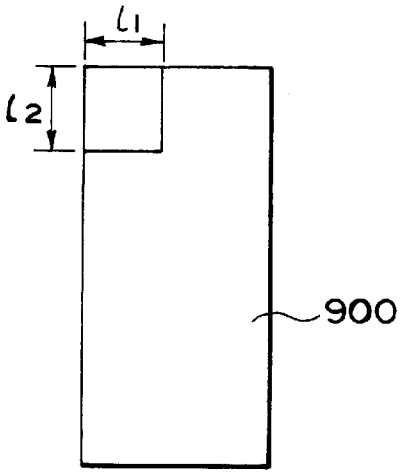
FIG. 13A and 13B show a first ink absorbing material according to an embodiment of the present invention.
Figure 13B:
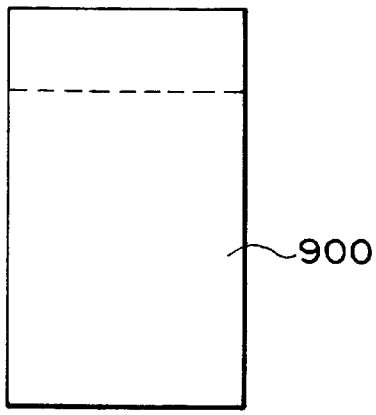

In FIGS. 13A and 13B, the first ink absorbing material 900 is partially cut away at the portion having the dimension of $l_1$, $l_2$ at a corner to provide a stepped portion. The lengths $l_1$ and $l_2$ are smaller than the second ink absorbing material 902 so as to press-contact the second absorbing material 902 of FIG. 14 to the inside surface of the ink container. In this embodiment, the diameter of the second ink absorbing material 902 is 16 mm, and the lengths $l_1$ and $l_2$ are 11 mm and 12 mm, respectively. With these dimensions, the press-contact between the first ink absorbing material 900 and the second ink absorbing material 902 was satisfactory at the cut-away portion of the absorbing material 900.

In FIG. 14, the area of the opening 904 of the flexible sheet 903 where the first ink absorbing material 900 and the second ink absorbing material 902 are directly press-contacted is determined on the basis of the characteristics of the recording head and the rate of ink supply required.

Figure 14A:
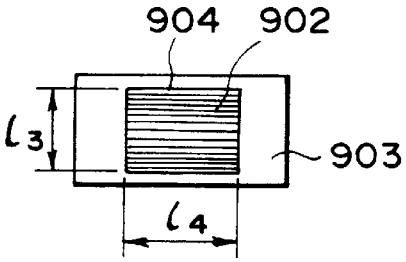
FIGS. 14A and 14B show fibers extending in one direction, according to an embodiment of the present invention.
Figure 14B:
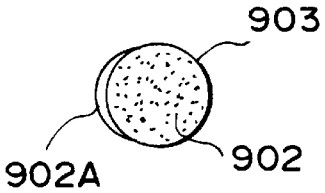

In this embodiment, the lengths 13 and 14 are preferably 12 mm and 16 mm, respectively. If the area of the opening 904 is not less than 100 $mm^2$, the fibers 902 are assuredly projected slightly through the opening, as shown in FIG. 14B, so that the side of the bundle of the fibers are partly formed into a projection or bulge 902A. The bulge 902A functions to receive the ink efficiently and not to receive the air.

As described in the foregoing, according to this embodiment, when the desired content of the ink is obtained by partly discharging the ink after the ink is supplied, the press-contact of the flexible sheet enclosing the one directional fibers to the inside surface of the ink cartridge is effective to shut the air coming along the surface, and therefore, the introduction of the air into the ink jet unit can be prevented, thus stabilizing the ink supply.

The ink is discharged or removed from the absorbing material having the lower absorbing characteristics (porous material or the like) than the one directional fibers, and therefore, the fibers are not influenced by the non-uniform distribution of the ink at the time of the ink discharge. As a result, the introduction of the air into the ink jet unit can be prevented, thus providing the smooth ink supply.

Figure 15:
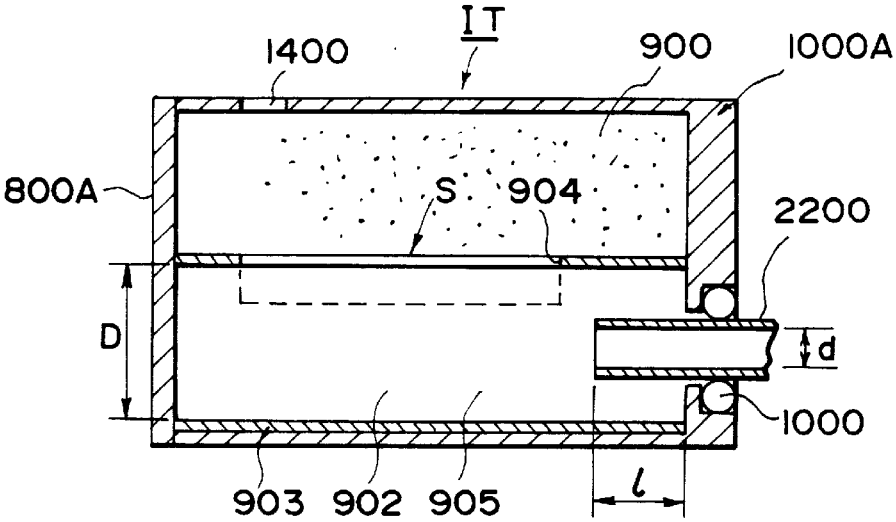
FIG. 15 shows the ink container, according to an embodiment of the present invention.

FIG. 15 illustrates a further embodiment of the present invention. The ink container IT generally comprises a main assembly 100A and a cover 800A for covering the opening of the main assembly 100A.

Into the main assembly 1000A, an end of an ink supply pipe 2200 is inserted through one wall thereof. The ink supply pipe 2200 functions as an ink supply passage for supplying the ink in the main assembly 100A to the ink ejector of the ink jet head. In the main assembly 1000A, there are a first absorbing material 900 made of a porous material such as polyurethane resin or the like to retain the ink and a second absorbing material 905 comprising a bundle of one directional fibers 902 (not shown) may be polyester resin or the like and a flexible material tube 903 made of polyethylene resin or the like and enclosing the bundle of the fibers. They are compressed in the container main assembly 1000A. The tube 903 enclosing the second absorbing material 905 is provided with an opening 904 functioning as an ink supply port from the first absorbing material 900 to the inside 905 of the second absorbing material. The fibers 902 extend in the direction of the length of the tube 903, and the bundle thereof is compressed in the direction substantially perpendicular to the direction in which the fibers extend. A sealing member 1000B is effective to prevent the leakage of the ink.

In this structure, the porous material constituting the first absorbing material 900 is contacted to the peripheral portion of the bundle of the fibers 902 constituting the second absorbing material 905 through the opening 904 of the tube 903, and therefore, the ink supply from the first absorbing material 904 to the second absorbing material 905 is assured. The end of the ink supply pipe 2200 is pressed into the central portion of an end of the bundle 902 enclosed by the tube 903, so that the end is positioned in the container main assembly 1000A.

It is preferable that the ink container IT has the opening 904 in the tube 903, the opening having the area S which is not less than 100 $mm^2$. The depth of insertion of the ink supply pipe 2200 at the end into the tube 903 (l) is preferably not less than 3 mm, and the inside diameter D of the tube 903 is not less than 1.5 (further preferably 2.0) times the inside diameter d of the ink supply pipe 2200 at the end. By satisfying them, the ink supply is stabilized at high efficiency without influence to the ejection performance by the ink ejector. These conditions are preferable since they are satisfied, the advantageous effects of the present invention are assured with the manufacturing error or the like. The high rate ink supply is possible to permit high speed recording operation. It is further preferable that the supply pipe is inserted into the fibers at the center of the bundle thereof, and also it is preferable that the direction in which the fibers extend is codirectional with the supply pipe. The diameter of the supply pipe is preferably not more than 10 times, or further preferably 5 times the diameter of the bundle of the fibers.

In this manner, the concentrated ink supply by the bundle of the fibers with the difference of not less than 3 mm is effective to delay the arrival of the air to the end of the supply pipe almost until the ink is used up.

The contact in the area not less than 100 $mm^2$ between the first absorbing material of the porous material and the second absorbing material of fibers, is effective to prevent the discontinuance of the ink supply path between the first absorbing material to the second absorbing material even when the remaining amount of the ink reduces or even when the ambient condition changes.

Figure 16:
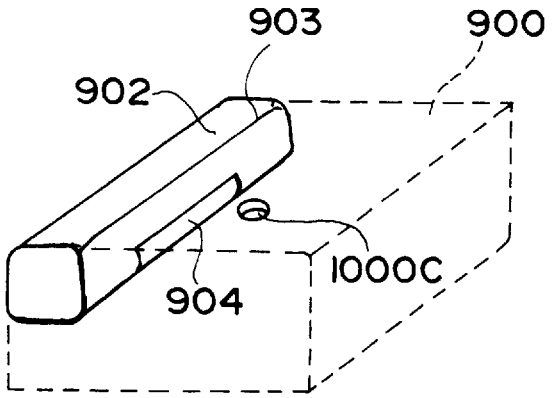
FIG. 16 shows an ink container illustrating a method of filling it with ink.
Figure 17:
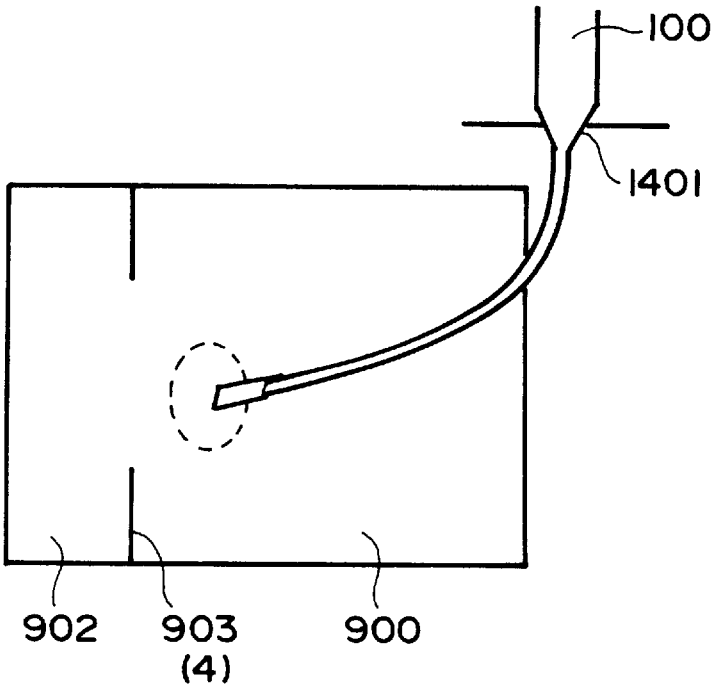
FIG. 17 shows a major part used in the method of FIG. 16.

FIGS. 16 and 17 illustrate a further embodiment. In the present invention, the ink supply is better than in the conventional structure even if the ink container contains a small amount of air. However, at the initial stage of the use of the ink container, it is preferable that there is no air adjacent the contact area between the different absorbing materials. In this embodiment, the ink can be supplied or re-supplied into the container so that the air does not exists in the neighborhood of the contact portion between the two ink absorbing materials. In order to solve the problem, the recording head of this embodiment is characterized by the ink injecting opening formed in the ink container wall in the neighborhood of the opening for permitting direct contact between the porous material and the bundle of the fibers.

With this structure, the discharge outlet of the ink container is sealed; the air is removed through the above-described air vent 1401 until the vacuum of the inside of the ink container is sufficient; the air vent 1401 is closed; and the ink is injected through the injection opening. By doing so, the air does not remain in the ink absorbing material, particularly the portion between the absorbing materials.

In addition, a small diameter pipe is inserted into the porous material through the air vent, and the ink is injected through the pipe so that the air does not remain in the ink container.

FIG. 16 shows a further embodiment. In this Figure, the same reference numerals as in the foregoing embodiments are assigned to the elements having the corresponding functions, and the detailed descriptions thereof are omitted.

An ink injecting opening 1000C is provided in the ink container itself and is formed adjacent the opening 904 of the tube 903 enclosing the fibers 902 at the side where the porous material 900 is formed. When the ink is supplied through the air vent, the air remains in the neighborhood of the opening 904 of the tube 903. However, by injecting the ink through the injection opening 1000C, the air in the porous absorbing material is easily moved to the air vent. In addition, the ink is supplied into the fibers through the opening 904, and therefore, the air removal from the contact area is assured.

By injecting the ink through the injection opening 1000C adjacent the opening 904, the quantity of the remaining air can be reduced.

It is preferable that the ink injecting opening 1000C is provided with a removable cap permitting the re-injection of the ink, so that the recording head is reusable.

FIG. 17 shows a further embodiment wherein without the injecting opening 1000C of FIG. 14, the same advantages can be provided using the air vent 1401. It is preferable that the injection end of the liquid injecting pipe is positioned to the neighborhood of the contact area between the different ink absorbing materials, and the ink is supplied there. The end of the injecting pipe may be positioned to the porous material and the fibers. It is most preferable that the end is positioned correctly at the contact position. When the ink container is to be refilled, there exists the remaining ink in the contact portion, and therefore, the end of the injecting pipe may be slightly away from the contact portion, as compared with the case of the initial supply of the ink thereto. In any case, the ink is injected at the neighborhood of the contact portion of the ink container.

By inserting the small diameter pipe 100 through the air vent, as shown in FIG. 17, the same advantageous effects as in the foregoing embodiment can be provided.

As described in the foregoing, in the ink container having plural absorbing materials, the ink injecting opening is disposed adjacent the opening permitting the motion of the ink between the absorbing materials, and therefore, the quantity of the ink remaining in the container in the absorbing materials can be reduced.

Since the ink supply side absorbing material of the recording head is constituted by fibers enclosed by a compressing tube, the capillary force is increased, so that the air is not easily accumulated below the filter.

Without use of this method, the ink container becomes non-usable in one hour at 60° C. acceleration test due to the introduction of the air, but with the use of this method, it is extended to 16 hours.

Figure 18:
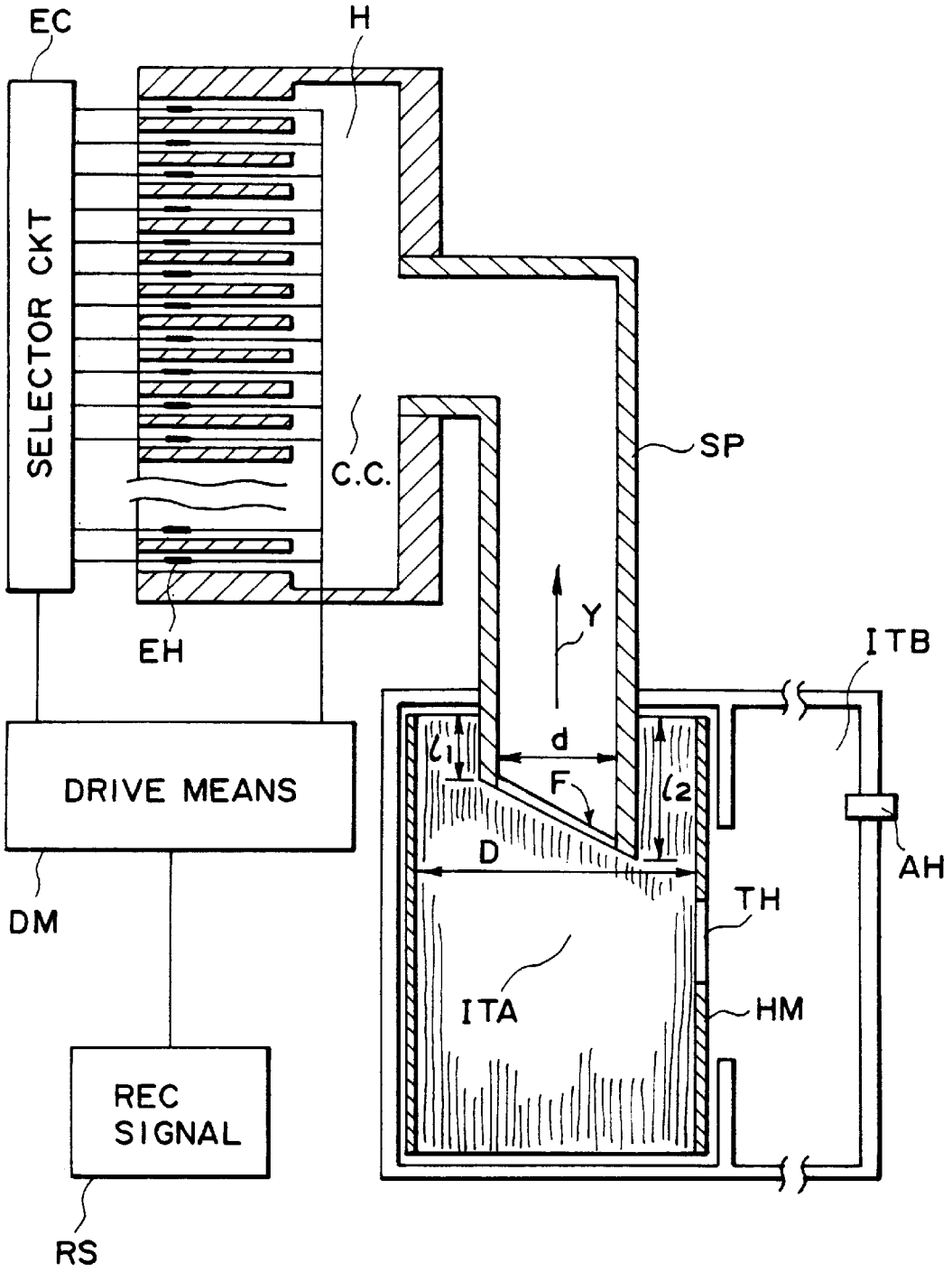
FIG. 18 shows a driving mechanism for a recording head.

FIG. 18 shows an ink jet recording apparatus having electrothermal transducers with plural ejection outlets, which is suitably usable with the present invention.

An ink jet head H comprises at least 10 ejection outlets, the electrothermal transducers EH corresponding to the ejection outlets and a common liquid chamber C commonly communicating with the ejection outlets. A supply pipe SP functions to supply the ink from the ink containing portion to the common liquid chamber. A selection circuit EC functions to individually or simultaneously drive the electrothermal transducers EH. The recording heads has a common electrode and is driven by a driving means DM. A recording signal generator RS comprises reading means, communication means, receiver or a host computer or the like. The driving means DM is responsive to the recording signal RS, and is capable of driving the electrothermal transducers at the driving frequency of not less than 5 KHz. The direction of the ink supply in the pipe SP is indicated by a reference Y.

In FIG. 18, the ink container has the structure of any one of the foregoing embodiments. The fibers are indicated by ITA, the partition member is indicated by HM, the opening of the partition member is indicated by TH, the air vent is indicated by AH, the ink retaining portion is indicated by ITS, which may be in the form of the above-described porous material or the cavity.

In this embodiment, an end of the ink supply pipe is tapered, and a filter is provided for the end, so that the filter is inclined relative to the direction of the fibers. The depth of the insertion in the partition member HM is $l_1$ at minimum and $l_2$ at the maximum. In this case, the insertion depth l is considered as $(l_1+l_2)/2$ in the foregoing embodiment, and therefore, $(l_1+l_2)/2 \geqq 3$ mm is practically preferable. Further preferably, the minimum depth $l_1$ satisfies $l_1 \geqq 3$ mm. The inside diameter of the supply pipe is perpendicular to the ink supply direction Y, and therefore it is the inside diameter d at the position in the partition member HM, and therefore, $S \geqq 100$ mm$^2$, $d \geqq 1.5D$, $l \leqq 3$ mm are preferable.

The typical structure and the operational principle are preferably the one disclosed in U.S. Pat. Nos. 4,723,129 and 4,740,796. The principle is applicable to a so-called. on-demand type recording system and a continuous type recording system particularly. However, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a vent portion in addition to the structure of the combination of the ejection outlet, liquid passage and the electrothermal transducer as disclosed in the abovementioned patents. In addition, the present invention is applicable to the structure disclosed in Japanese Laid-Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of recording heads mountable, it may be a single head corresponding to a single color ink, or may be plural heads corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

As described in the foregoing, according to the present invention, even if the air is introduced into the first ink absorbing material, it is not introduced into the second ink absorbing material constituted by fibers extended in the same direction. Therefore, the air is not accumulated in the neighborhood of the supply port.

Therefore, the ink supply is not stopped by the air, thus stably supplying the ink.

In addition, according to the present invention, plural absorbing materials having different configurations and materials are disposed with a partition wall therebetween, which is integral with the inside wall of the container. Therefore, the motion of the air due to the consumption of the ink can be delayed, so that the improper ink supply occurrence can be significantly delayed or completely avoided. Therefore, ink can be consumed efficiently in connection with the amount of the ink contained in the container.

While the invention has been described with reference to the structures disclosed herein, it is not confined to the details set forth and this application is intended to cover such modifications or changes as may come within the purposes of the improvements or the scope of the following claims.

What is claimed is:

1. An ink container connectable with an ink supply tube of a recording head, comprising:

a container body;

an ink supply portion, provided at a first position of said container body, for receiving the ink supply tube to supply ink to said recording head;

an air vent, provided at a second position of said container body, for fluid communication between an inside and an outside of said container body;

a first ink absorbing material, of fibrous material, for retaining the ink therein, said first ink absorbing material accommodated in a part of said container body so as to cover said ink supply portion; and a second ink absorbing material, of porous material, for retaining the ink therein, said second ink absorbing material occupying substantially an entire space in said container body except for said first ink absorbing material;

wherein said first ink absorbing material and said second ink absorbing material are at least partly in contact with each other, said first ink absorbing material being in the form of a block of fibers extending in a direction toward said ink supply portion, said fibrous material being abutted by an end of the ink supply tube; and wherein said first ink absorbing material has a capillary force which is larger than that of said second ink absorbing material.

2. A container as claimed in claim 1, further comprising a partition member for providing a first region for accommodating said first ink absorbing material and a second region for accommodating said second ink absorbing material, said partition member comprising an opening for permitting contact between said first ink absorbing material and second ink absorbing material.

3. An ink container as claimed in claim 1 or 2, wherein said first ink absorbing material comprises fibers which are compressed.

4. A container as claimed in claim 3, wherein said second ink absorbing material includes a continuous porous elastic material which is compressed.

5. A container as claimed in claim 4, wherein the first ink absorbing material and the second ink absorbing material contact each other adjacent to a center of a length of a bundle of the fibrous material of the first ink absorbing material.

6. A container as claimed in claim 5, wherein a longitudinal portion at an end of the bundle of the fibrous material at a central portion of the end of the bundle is compressed fibrous material.

7. A container as claimed in claim 3, wherein the first ink absorbing material and the second ink absorbing material contact each other adjacent to a center of a length of a bundle of the fibrous material of the first ink absorbing material.

8. A container as claimed in claim 7, wherein a longitudinal portion at an end of the bundle of the fibrous material at a central portion of the end of the bundle is compressed fibrous material.

9. A container as claimed in claim 1 or 2, wherein said second ink absorbing material includes a continuous porous elastic material which is compressed.

10. A container as claimed in claim 9, wherein the first ink absorbing material and the second ink absorbing material contact each other adjacent to a center of a length of a bundle of the fibrous material of the first ink absorbing material.

11. A container as claimed in claim 10, wherein a longitudinal portion at an end of the bundle of the fibrous material at a central portion of the end of the bundle is compressed fibrous material.

12. A container as claimed in claim 2, wherein said partition member is in the form of a flexible resin sheet enclosing the fibrous material and is contained in said ink container in contact with said first ink absorbing material.

13. A container as claimed in claims 1 or 2, wherein said first ink absorbing material has a property of increasing its volume when the ink is removed therefrom, and said second ink absorbing material has a property of increasing its volume by absorbing air when it supplies the ink to said first ink absorbing material, and a capillary force in the first ink absorbing material is larger than in the second ink absorbing material.

14. A container as claimed in claim 1 or 2, wherein the first ink absorbing material and the second ink absorbing material contact each other adjacent to a center of a length of a bundle of the fibrous material of the first ink absorbing material.

15. A container as claimed in claim 14, wherein a longitudinal portion at an end of the bundle of the fibrous material at a central portion of the end of the bundle is compressed fibrous material.

16. An ink jet recording head comprising an ink container as claimed in claim 1; a number of ejection outlets for ejecting the ink; a common chamber for supplying the ink toward the ejection outlets; and an ink supply member for supplying the ink from said container to the common chamber.

17. An ink jet recording head comprising an ink container as claimed in claim 2; a number of ejection outlets for ejecting the ink; a common chamber for supplying the ink toward the ejection outlets; and an ink supply member for supplying the ink from said container to the common chamber.

18. A recording head as claimed in claim 16 or 17, wherein the number of the ejection outlets is not less than 10, and said recording head further comprises electrothermal transducers for creating a bubble through film boiling by thermal energy provided for respective ejecting portions, and a filter at an end of the ink supply member, said filter being inserted into the fibrous material in the direction of the length thereof.

19. A recording apparatus having a recording head as claimed in claim 18, further comprising driving means for driving the electrothermal transducers at a frequency not less than 5 kHz.

20. A recording head as claimed in claim 17, wherein said ink supply member is provided with a filter at an ink receiving end thereof, said filter being inserted into said first ink absorbing material in the direction of the length of the fibrous material, the depth of the insertion being not less than 3 mm, and a diameter D of said ink supply member in a perpendicular cross-section with respect to the direction of the ink supply adjacent the filter of the ink supply member and a diameter d of said first ink absorbing material in the perpendicular cross-section adjacent the filter satisfy the equation $d \geqq 1.5D$, and the opening has an area not less than 100 $mm^2$.

21. A method of supplying ink to an ink container connectable with an ink supply tube of a recording head, the ink container comprising (a) a container body, (b) an ink supply portion, provided at a first position of said container body, for receiving an ink supply tube to supply ink to said recording head, (c) an air vent, provided at a second position of said container body, for fluid communication between an inside and an outside of said container body, (d) a first ink absorbing material, of fibrous material, for retaining the ink therein, said first ink absorbing material accommodated in a part of said container body so as to cover said ink supply portion, and (e) a second ink absorbing material, of porous material, for retaining the ink therein, said second ink absorbing material occupying substantially an entire space in said container body except for said first ink absorbing material, said first ink absorbing material and said second ink absorbing material being at least partly in contact with each other, said first ink absorbing material being in the form of a block of fibers extending in a direction toward said ink supply portion, said fibrous material being abutted by an end of the supply tube, said first ink absorbing material having a capillary force which is larger than that of said second ink absorbing material, said method comprising the steps of:

inserting an ink supply pipe so that an end of the ink supply pipe is adjacent to the contact portion; and supplying the ink through the ink supply pipe.

22. A method of supplying ink to a recording head, the recording head comprising (a) an ink container, the ink container including (i) a container body, (ii) an ink supply portion, provided at a first position of said container body, for receiving an ink supply tube to supply ink to said recording head, (iii) an air vent, provided at a second position of said container body, for fluid communication between an inside and an outside of said container body, (iv) a first ink absorbing material, of fibrous material, for retaining the ink therein, said first ink absorbing material accommodated in a part of said container body so as to cover said ink supply portion, and (v) a second ink absorbing material, of porous material, for retaining the ink therein, said second ink absorbing material occupying substantially an entire space in said container body except for said first ink absorbing material, said first ink absorbing material and said second ink absorbing material being at least partly in contact with each other, said first ink absorbing material being in the form of a block of fibers extending in a direction toward said ink supply portion, said fibrous material being abutted by an end of the ink supply tube, and said first ink absorbing material having a capillary force which is larger than that of said second ink absorbing material, (b) a number of ejection outlets for ejecting the ink, (c) a common chamber for supplying the ink toward the ejection outlets, and (d) an ink supply member for supplying the ink from said container to the common chamber, said method comprising the steps of:

inserting an ink supply pipe so that an end of the ink supply pipe is adjacent to the contact portion; and supplying the ink through the ink supply pipe.

23. A method of supplying ink to a recording apparatus, the recording apparatus comprising (a) a recording head, the recording head including (i) an ink container, the ink container including (A) a container body, (B) an ink supply portion, provided at a first position of said container body, for receiving an ink supply tube to supply ink to said recording head, (C) an air vent, provided at a second position of said container body, for fluid communication between an inside and an outside of said container body, (D) a first ink absorbing material, of fibrous material, for retaining the ink therein, said first ink absorbing material accommodated in a part of said container body so as to cover said ink supply portion, and (E) a second ink absorbing material, of porous material, for retaining the ink therein, said second ink absorbing material occupying substantially an entire space in said container body except for said first ink absorbing material, said first ink absorbing material and said second ink absorbing material being at least partly in contact with each other, said first ink absorbing material being in the form of a block of fibers extending in a direction toward said ink supply portion, said fibrous material being abutted by an end of the ink supply tube, said first ink absorbing material having a capillary force which is larger than that of said second ink absorbing material, (ii) a number of ejection outlets for ejecting the ink, (iii) a common chamber for supplying the ink toward the ejection outlets, (iv) an ink supply member for supplying the ink from said container to the common chamber, and (v) electrothermal transducers, and (b) driving means for driving the electrothermal transducers at a frequency not less than 5 kHz, said method comprising the steps of:

inserting an ink supply pipe so that an end of the ink supply pipe is adjacent to the contact portion; and supplying the ink through the ink supply pipe.

24. A recording liquid container connectable with a liquid ejection head having a recording liquid receiving tube, said container comprising:

container means having a recording liquid supply port, provided at a first position of said container means, for receiving the recording liquid receiving tube, and an air vent portion, provided at a second portion of said container body, in fluid communication with ambient surroundings;

a liquid absorbing material, of porous material, accommodated in said container means; and a bundle of fibrous material accommodated in a part of said container means so as to cover said recording liquid supply port, wherein said bundle includes fibers extended substantially unidirectionally, and wherein an end surface of said bundle is faced to said recording liquid supply port.

25. A container according to claim 24, wherein a direction in which said fibers are extended is along a direction of flow of the recording liquid.

26. A container according to claim 24, wherein the end surface of said bundle is press-contacted by the recording liquid receiving tube when said container is connected to the liquid ejection head.

27. A container according to claim 24, wherein said container means contains the recording liquid.

28. A recording liquid container connectable with a liquid ejection head having a recording liquid receiving tube, said container comprising:

container means having a recording liquid supply port, provided at a first position of said container means, for receiving the recording liquid receiving tube, and an air vent portion, provided at a second position of said container body, in fluid communication with ambient surroundings;

a liquid absorbing material, of porous material, accommodated in said container means; and a bundle of fibrous material accommodated in a part of said container means so as to cover said recording liquid supply port, wherein said bundle includes fibers extended substantially unidirectionally toward said recording liquid supply port.

29. A container according to claim 28, wherein a direction in which said fibers are extended is along a direction of flow of the recording liquid.

30. A container according to claim 28, wherein an end surface of said bundle is press-contacted by the recording liquid receiving tube when said container is connected to the liquid ejection head.

31. A container according to claim 28, wherein said container means contains the recording liquid.

* * * * *